United States Patent [19]

Ohkanda

[11] Patent Number: 4,922,868

[45] Date of Patent: May 8, 1990

[54] STARTING SYSTEM

[75] Inventor: Masao Ohkanda, Sagamihara, Japan

[73] Assignee: Kioritz Corporation, Tokyo, Japan

[21] Appl. No.: 343,703

[22] Filed: Apr. 27, 1989

[30] Foreign Application Priority Data

Apr. 27, 1988 [JP] Japan ..... 63-55906[U]

[51] Int. Cl.[5] ..... F02N 3/02; F02N 11/00

[52] U.S. Cl. ..... 123/179 P; 74/7 C; 74/7 E; 74/625; 192/42

[58] Field of Search ..... 123/179 P, 179 M, 179 SE, 123/185 A, 185 B, 185 BA; 74/7 E, 7 C, 625; 192/42

[56] References Cited

U.S. PATENT DOCUMENTS

| | | | |
|---|---|---|---|
| 2,939,448 | 6/1960 | Hansen | 123/179 P |
| 3,219,021 | 11/1965 | Mercer et al. | 123/179 P |
| 3,405,293 | 10/1968 | Burkett et al. | 310/74 |
| 3,570,464 | 3/1971 | Morabit et al. | 123/185 |
| 4,848,288 | 7/1989 | Murase et al. | 123/179 P |

FOREIGN PATENT DOCUMENTS

| | | |
|---|---|---|
| 442366 | 1/1944 | Japan . |
| 63-79471 | 5/1988 | Japan . |

*Primary Examiner*—Andrew M. Dolinar
*Attorney, Agent, or Firm*—Browdy and Neimark

[57] ABSTRACT

A starting system having: a recoil type starter disposed so as to be concentric with a crankshaft of an internal combustion engine and to face one end of the same, the recoil starter having a recoil drum having a hollow boss portion and an engaging portion formed at its one side facing the one end of the crankshaft; a motor starter; a rotary shaft inserted into the hollow boss portion of the rotary drum concentrically therewith and capable of being rotated by the motor starter; a shock absorbing spring disposed around the rotary shaft; and ratchet members disposed at the one end of the crankshaft, the ratchet members being capable of respectively engaging with the spring and the engaging portion.

2 Claims, 1 Drawing Sheet

STARTING SYSTEM

BACKGROUND OF THE INVENTION

This invention relates to a starting system having a recoil type starter and a motor starter.

While internal combustion engines for portable working machines are ordinarily provided with a recoil type starter, a type of internal combustion engine system having a motor starter along with a recoil type starter has been developed. This type of system is designed to selectively used one of these starters and to thereby enable even persons of insufficient physical strength, e.g., women or the aged to easily operate the internal combustion engine. However, such an internal combustion engine system has a complicated structure and necessarily has a larger overall size. Moreover, a large impact load is applied when the motor starter is operated to start the engine. Development of a novel system capable of smoothly starting the engine is therefore expected.

SUMMARY OF THE INVENTION

It is therefore an object of the present invention to provide a useful starting system having a recoil type starter and a motor starter, having a similar and smaller structure, easy to assemble, easy to check or overhaul for maintenance, and free of any considerable impacts at the time of starting.

To this end, the present invention provides a starting system including: a recoil type starter disposed so as to be concentric with a crankshaft of an internal combustion engine and to face one end of the crankshaft, the recoil starter having a recoil drum having a hollow boss portion and an engaging portion formed at one side facing said one end of the crankshaft; a motor starter; a rotary shaft inserted into the hollow boss portion of the rotary drum concentrically therewith and capable of being rotated by the motor starter; a shock absorbing spring disposed around the rotary shaft; and ratchet members disposed at said one end of the crankshaft, the ratchet members being capable of respectively engaging with the spring and the engaging portion; wherein when one of the starters is operated, at least one of the ratchet members is brought into engagement with the engaging portion or the spring, and is disengaged from the starter by the centrifugal force caused by the rotation of the ratchet member as the rotational speed of the crankshaft increases after the internal combustion engine has been started.

This construction of the present invention enables the recoil starter, the motor starter, the reduction gear and the shock absorbing spring to be assembled into a compact unit; rotary members of the two starters are disposed concentrically with each other to integrally combine the starters. This construction also enables the engine to be started smoothly by virtue of the shock absorbing spring while enabling selective use of each starter.

The thus-constructed starting system of the present invention in which the rotary members of the recoil starter and the motor starter are disposed concentrically and the shock absorbing spring is disposed around the rotary shaft has a simpler and smaller overall structure, is improved in handling for assembly, overhauling and maintenance and is capable of absorbing in the shock absorbing spring a large impact load caused by the motor starter.

BRIEF DESCRIPTION OF THE DRAWINGS

The accompanying drawings illustrate a starting apparatus which represents an embodiment of the present invention.

DESCRIPTION OF THE PREFERRED EMBODIMENT

An embodiment of the present invention will be described below with reference to the accompanying drawings.

Figure 1:
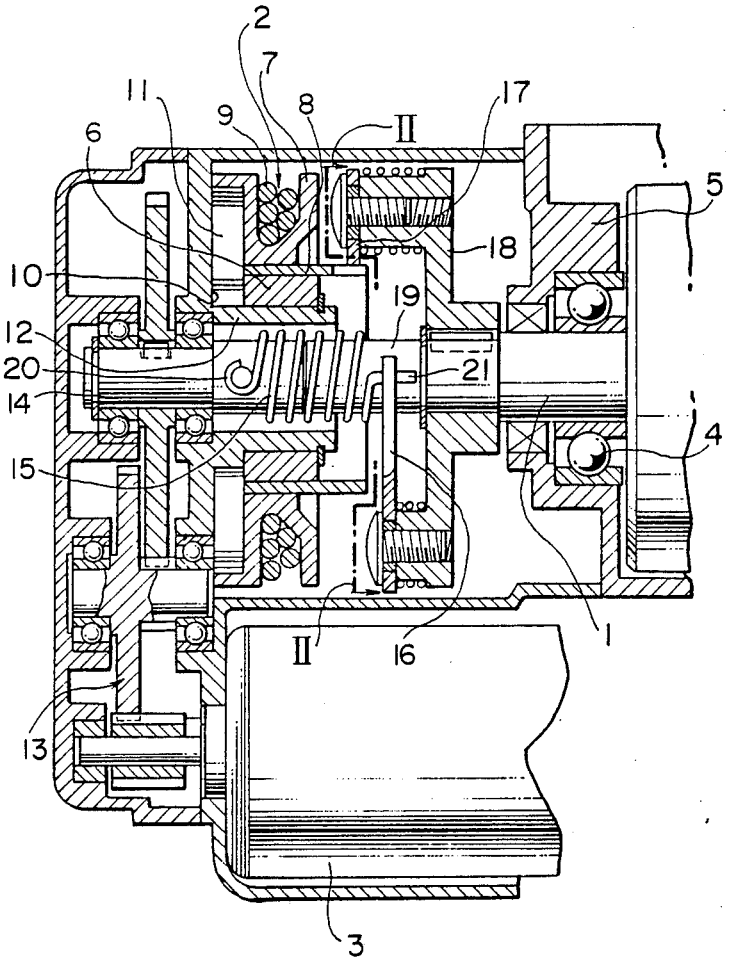
FIG. 1 is a cross-sectional view of essential portions of the starting apparatus.
Figure 2:
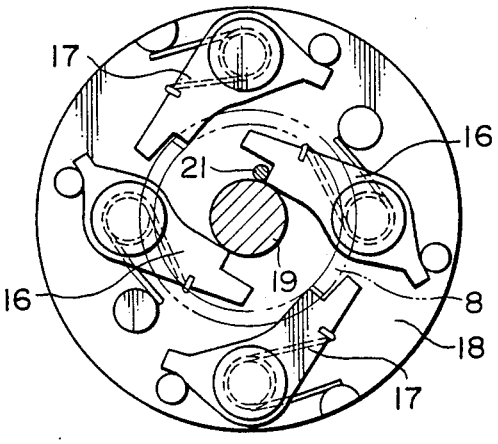
FIG. 2 is a cross-sectional view taken along the line II—II of FIG. 1.

The illustrated embodiment is constructed at one output end of a crankshaft 1 of an internal combustion engine for, for example, a power sprayer which is shouldered when used. The other output end (not shown) of the crankshaft 1 extending generally in the horizontal direction as viewed in FIG. 1 is connected to, for example, a centrifugal fan. A recoil type starter 2 is disposed so as to face an end portion 19 of the crankshaft 1, and an electric motor starter 3 is disposed below and by the side of the recoil starter 2. A ball bearing 4 for rotatably supporting the crankshaft 1 is mounted on a main body case 5 of the internal combustion engine. Chambers in which the starters 2 and 3 are housed are formed on the outside of the main body case 5. The recoil starter 2 has an engaging portion 8 which is formed integrally with a recoil drum 7 having a hollow boss portion 6. A recoil rope 9 is wound in a groove formed in a peripheral portion of the recoil drum 7. The recoil drum 7 and a recoil starter wall 10 define a chamber in which a recoiling spiral spring 11 is accommodated. The hollow boss portion 6 is rotatably supported axially around a cylindrical projection 12 formed on the recoil starter wall 10. A rotary shaft 14 to which the torque of the motor starter 3 is transmitted through a reduction gear mechanism 13 is inserted into a cavity of the cylindrical projection 12. A spring wire 15 which serves as a shock absorbing spring is loosely wound around adjacent peripheral portions of the rotary shaft 14 and the end portion 19 of the crankshaft 1 in the direction opposite to the direction of rotation of the rotary shaft 14. One end 20 of the spring wire 15 is connected with the rotary shaft 14 while the other end 21 extends protrusively toward the crankshaft 1. A rotary member 18 on which two types of ratchet members 16 and 17 are mounted is fixed to the crankshaft 1, as shown in FIG. 2. When the recoil starter 2 or the motor starter 3 are operated to start the internal combustion engine, the torque can be transmitted to the crankshaft 1 through engagement between the engaging portion 8 or the spring wire 15 and the ratchet member 16 or 17, thereby rotating the crankshaft 1. When the speed of the crankshaft 1 becomes higher than a certain value after the internal combustion engine has been started, the ratchet member 16 or 17 is automatically disengaged from the starter by the effect of centrifugal force.

To start the engine by using the recoil starter 2, a grip (not shown) connected to the end of the recoil rope 9 extending to the outside is pulled by hand against the operation of the spiral spring 11, thereby rotating the recoil drum 7. The rotary member 18 is rotated together with the recoil drum 7 by the torque transmitted through the ratchet members 17 in engagement with the engaging portion 8, thus rotating the crankshaft 1. To start the engine by using the motor starter 3, the electric motor is electrically connected to a power source such as a battery (not shown), and the rotary shaft 14 is rotated by the torque of the motor through the reduction gear mechanism 13. The spring wire 15 is thereby rotated, so that the other end 21 of the spring wire 15 is brought into engagement with one of the ratchet members 16 as the spring wire 15 is wound tightly around the peripheral surfaces of the rotary shaft 14 and the crankshaft 1 while absorbing the shock, thereafter rotating the crankshaft 1.

What is claimed is:

1. A starting system comprising:

a recoil type starter disposed so as to be concentric with a crankshaft of an internal combustion engine and to face one end of said crankshaft, said recoil starter having a recoil drum having a hollow boss portion and an engaging portion formed at its one side facing said one end of said crankshaft;

a motor starter;

a rotary shaft inserted into said hollow boss portion of the rotary drum concentrically therewith and capable of being rotated by said motor starter;

a shock absorbing spring disposed around said rotary shaft; and ratchet members disposed at said one end of said crankshaft, said ratchet members being capable of respectively engaging with said spring and said engaging portion;

wherein when one of said starters is operated, at least one of said ratchet members is brought into engagement with said engaging portion or said spring, and is disengaged from said operating starter by the centrifugal force caused by the rotation of said ratchet member as the rotational speed of said crankshaft increases after the internal combustion engine has been started.

2. A starting system according to claim 1, wherein said motor starter is disposed below and by the side of said recoil type starter, and is capable of rotating said rotary shaft through a reduction gear mechanism.

* * * * *